United States Patent [19]

Helpinstill, II

[11] 4,212,220

[45] Jul. 15, 1980

[54] MAGNETIC SENSOR FOR A MUSICAL INSTRUMENT AND METHOD OF CONSTRUCTING SAME

[76] Inventor: Charles T. Helpinstill, II, 6124 Jessamine, Houston, Tex. 77036

[21] Appl. No.: 844,333

[22] Filed: Oct. 21, 1977

Related U.S. Application Data

[63] Continuation of Ser. No. 621,365, Oct. 10, 1975, abandoned.

[51] Int. Cl.[2] ..... G10H 3/00; H01F 27/02

[52] U.S. Cl. ..... 84/1.14; 84/1.16; 336/90

[58] Field of Search ..... 84/1.06, 1.14–1.16; 335/301–304; 336/90, 155, 20, 110, 84

[56] References Cited

U.S. PATENT DOCUMENTS

| | | | |
|---|---|---|---|
| 3,297,813 | 7/1967 | Cookerly et al. | 84/1.15 |
| 3,530,756 | 9/1970 | Chapman | 84/1.15 |
| 3,657,461 | 4/1972 | Freeman | 84/1.15 |
| 3,902,394 | 9/1975 | Stich | 84/1.15 |
| 3,932,827 | 1/1976 | Buarer | 336/60 |

*Primary Examiner*—Vit W. Miska
*Attorney, Agent, or Firm*—Gunn & Lee

[57] ABSTRACT

Method and apparatus are disclosed for a magnetic sensor for use with a musical instrument having magnetic vibrating elements. The magnetic sensor has two magnetic poles and comprises a flexible, electrostatically shielded coil-magnet, a cable coupled to the coil of the coil-magnet, and flexible non-conductive material encompassing the electrostatically shielded coil-magnet. The magnetic sensor may be attached to the frame of the instrument, so that one of its magnetic poles is in proximity to the vibrating elements of the instrument. Methods are also disclosed for adapting and converting an upright piano for electronic amplification by utilizing the magnetic sensor of the present invention.

15 Claims, 11 Drawing Figures

FIG. 1a
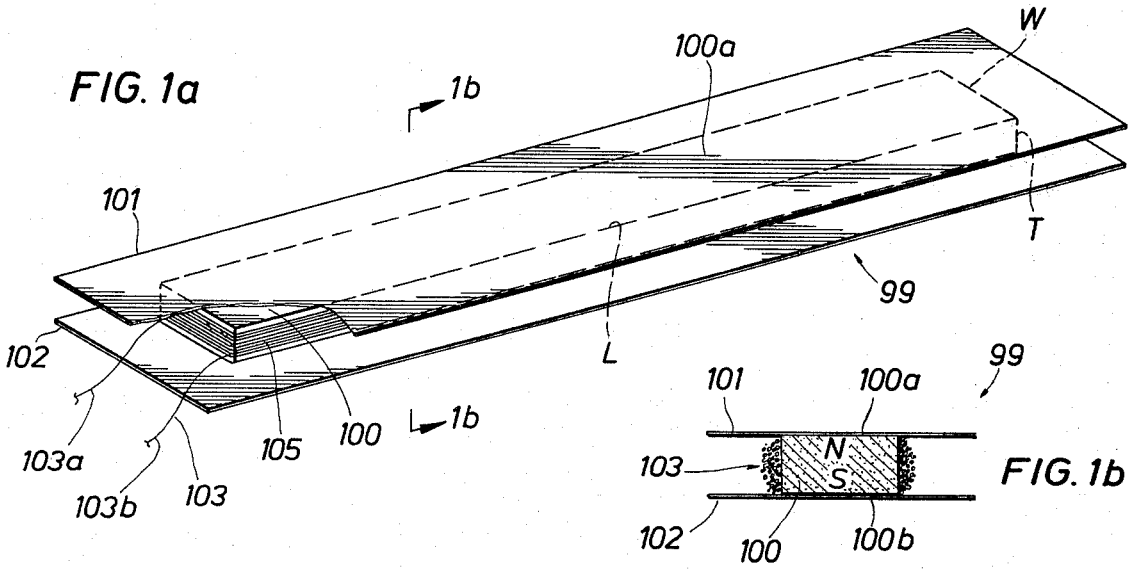
FIG. 1b
FIG. 1c
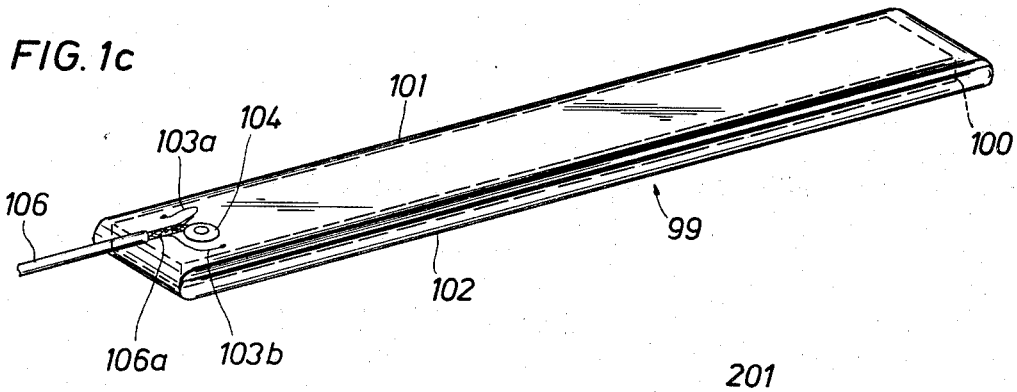
FIG. 2
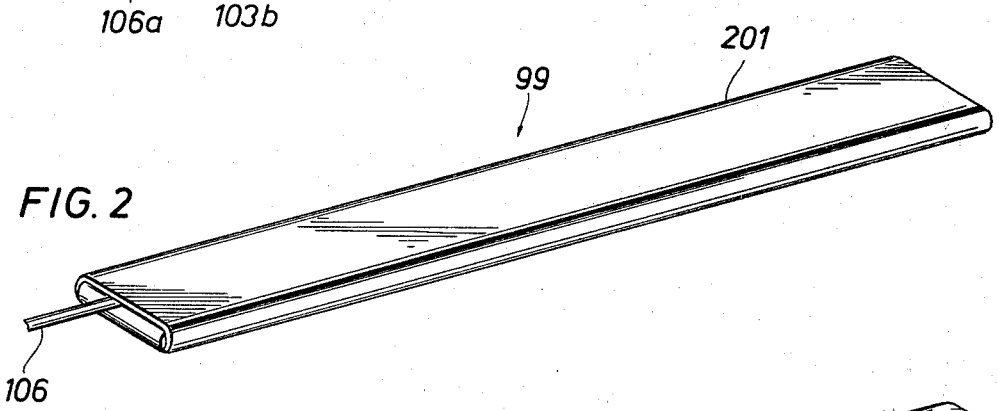
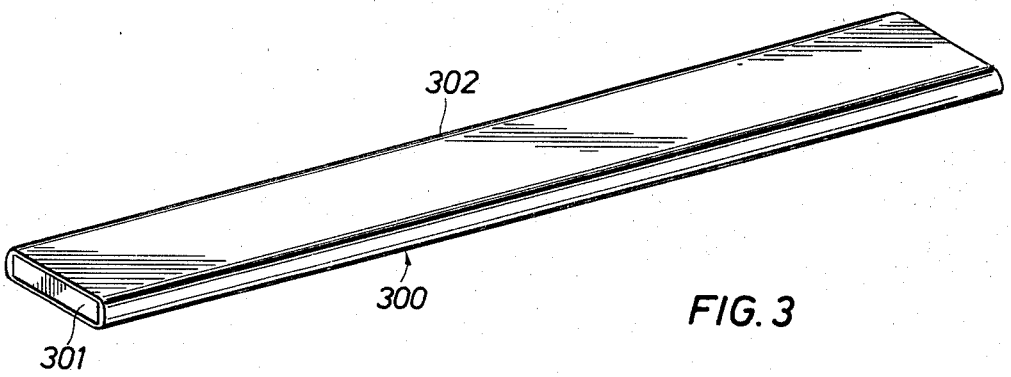
FIG. 3

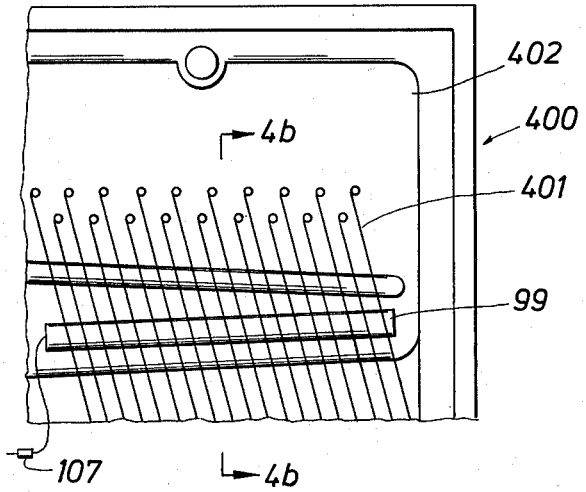
FIG. 4a
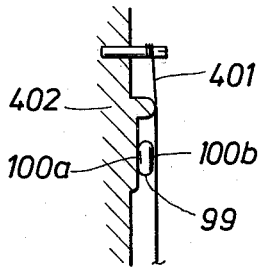
FIG. 4b
FIG. 5a
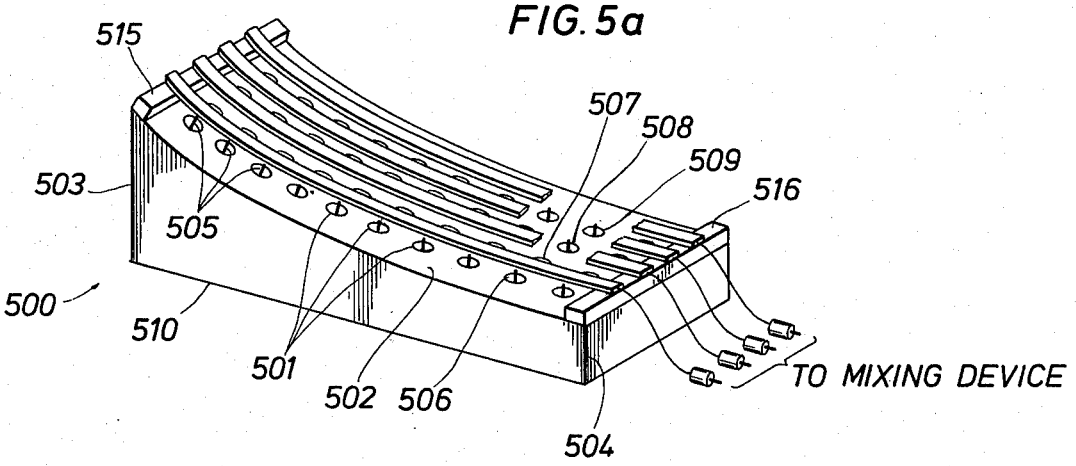
FIG. 5b
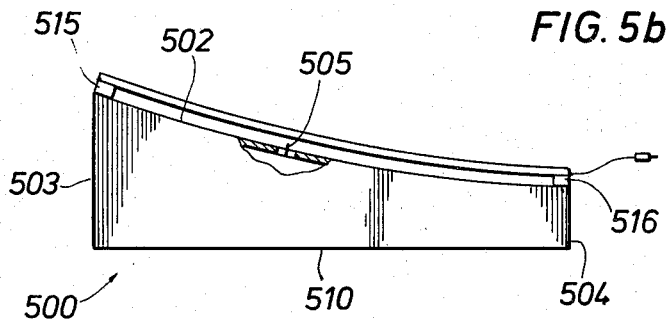

MAGNETIC SENSOR FOR A MUSICAL INSTRUMENT AND METHOD OF CONSTRUCTING SAME

This application is a continuation application of previously filed Ser. No. 621,365, filed on Oct. 10, 1975, and which application has been abandoned.

BACKGROUND OF THE INVENTION

1. FIELD OF THE INVENTION

The magnetic sensor of the present invention relates to musical instruments, and, more particularly, to an electronic sensing device for use with musical instruments having magnetic vibrating elements.

2. DESCRIPTION OF THE PRIOR ART

For several years people have attempted to amplify the musical output of a piano, and the magnetic sensor of the present invention is believed to be more understandable with reference to prior piano amplification techniques.

With any attempt to obtain a louder sound out of a piano, there are basically two problems to be solved, viz., feedback and bleedthrough. Feedback occurs because the whole sounding board of the piano acts as a sound gatherer for the amplification device, while bleedthrough occurs when the outputs of other instruments used in proxmity to the piano are picked up by the piano amplifying device. Bleedthrough might occur, for example, when a piano is used in a band or orchestra, and an amplification device is used on the piano.

Early attempts at piano amplification utilized conventional vocal microphones to amplify the sound output of the piano. This type of piano amplification proved undesirable for two reasons. First, a piano is a distributed sound source instrument as opposed to a point source instrument, like a trumpet. The piano sound is transferred to the surrounding air by the very large area of its sounding board. This sounding board usually requires no one point to be very loud, and it was found to be exceedly difficult to position a vocal microphone to adequately amplify the output of a piano. Secondly, if a plurality of microphones were utilized to amplify only specific portions of the output of the piano, then the phenomenon of phase-cancellation could very likely occur. Phase cancellation occurs when one note arrives at two microphones at slightly different times by traveling different distances to get to each microphone. The output of one microphone would, in these instances, tend to cancel the output of another microphone. Consequently, this amplification technique for a piano has not proven desirable.

Another atttempt to amplify the sound output of a piano consisted of the utilization of "contact microphones." These contact microphones were designed to be inserted between the sounding board of the piano and a support post in back of the piano. A wire emerged from the contact microphone for insertion into a suitable amplification device. Most of the contact transducers originally manufactured employed a dynamic microphone construction, but this construction technique has been abandoned today in favor of piezoelectric crystal devices. These crystal devices are popularly referred to in the art as transducers, and utilize construction techniques similar to those used in spring gauges and seismic sensors. These transducers, as well as their dynamic microphone predecessors, have proven ineffective in the amplification of the piano output. The reasons for this ineffectiveness are that it is difficult to locate the contact microphone for effective piano reproduction and that these transducers tend to pick up the sound output of other musical instruments used in proximity to the piano (bleedthrough).

In the 1960's, the electric guitar began to be used by many musical entertainment groups, and the amplification technique utilized by electric guitars proved to be the inspiration for effective piano amplification. The amplification technique employed by electric guitars is to sense only the vibrations of the string, and many of the feedback and bleedthrough problems became minimal by using this technique. The concept of sensing only the vibration of the piano strings did not meet with universal acceptance, however, because many thought that the "true acoustical sound" of a piano could only be obtained from dispersion of the piano sound from its wooden sounding board.

This so-called "warmth of the wood" rationale has largely been discredited today for several reasons. First, for all practical purposes the fundamental and harmonic frequency of every musical note of the amplifier are contained in the vibrating string. Secondly, the sounding board system is merely a mechanical amplifier, and the difference in sound between a well-constructed piano and a cheaper model resides in how well the wooden sounding board transfers these string vibrations into the surrounding air. Thus, it is a generally accepted principal today that the wooden sounding board can add little or nothing to the sound output of a piano, but it can only substract from the original perfect balance in varying degrees. Therefore, whatever "warmth" is present in the wooden sounding board of the piano must by necessity also be present in the piano strings when actuated.

One of the prior attempts at piano amplification was an electrostatic string sensing device. This device was designed for grand pianos and consisted of utilizing an electrostatic pickup to detect the vibrations of the strings of the piano. A typical electrostatic pickup consisted of a four foot rod to suspend metal plates above the strings. These plates were charged to about 200 volts, and the strings of the piano were grounded. A capacitance existed, therefore, between the string and the plates, and any movement of the strings amounted to a change in this capacitance. This change in capacitance produced a variation signal on the plates. The outputs of the plates were coupled to a mixing device which extracted the variation signal from the 200 volt bias of the plate, and suitable amplification was then applied to the extracted variation signals.

The electrostatic sensing systems have several inherent disadvantages which have resulted in them not being widely utilized as a piano amplifier. Since the charged plates and strings formed a capacitance, the performance of the pickup was subject to weather conditions. The humidity, for example, could affect the value of capacitance between the plate and strings. Consequently, when the mixing device was designed to extract a 200 volt level from the outputs of the plate, then the value of the extracted variation signal could vary greatly. Furthermore, the metal plates were hard to shield and were subject to radio frequency interference. Also, it should be apparent from the above discussion that the electrostatic sensing devices required a high voltage power supply for proper operation.

The next approach to piano amplification was also designed primarily for use on grand pianos and consisted of sensing the vibration of the strings with a plurality of magnetic pickups. One such pickup which is still utilized is the Helpinstill piano pickup Model 175 which is produced by Helpinstill Designs of Houston, Texas. This piano pickup resembles the electrostatic sensing devices in that both devices sense all the strings with a framework that is placed across the same area of the piano. However, in the case of the magnetic string sensing device, coil-magnet assemblies are utilized in the pickup device instead of charged metal plates. Uniform pickups of any string underneath the whole length of the coil-magnet is realized without the necessity of a magnet and coil for each string.

As aforementioned, the magnet string sensing devices were originally designed for utilization on grand pianos, and they have enjoyed a not insubstantial amount of success for this purpose. It has been found that many entertainment groups are unable to use the magnetic pickup. The reason for this is simple, viz., they do not own or have a grand piano at their disposal. Efforts have been made to incorporate the magnetic sensing device of the Helpinstill Model 175 into other types of pianos besides grand pianos. This proved to be a laborious and often unsuccessful task and has not been actively pursued.

In the course of trying to modify other pianos to accept the Helpinstill Model 175 magnetic sensing system, it was discovered that the rubber strip magnets utilized in the coil-magnet assemblies of the Model 175 would magnetically adhere to the framework of a piano. This discovery led to the development of the magnetic sensor of the present invention and to the method of adapting an upright piano for electronic amplification of the present invention.

SUMMARY OF THE INVENTION

A magnetic sensor is provided for use in a musical instrument having a vibrating magnetic material to produce musical notes. The magnetic sensor is designed to be attached to the frame of the instrument so that it is in proximity to the vibrating magnetic elements. As the vibrating magnetic elements vibrate, an electrical signal is produced at the output of the magnetic sensor. This output may be coupled to a suitable amplification device to amplify the electrical signal produced.

One embodiment of the magnetic sensor of the present invention comprises a flexible, electrostatically shielded coil-magnet, a two-wire cable, and flexible, non-conductive material. The conductors at one end of the two-wire cable are coupled across the coil of the coil-magnet, and the flexible, non-conductive material is utilized to encompass the electrostatically shielded coil-magnet and the connection between the two-wire cable and the coil of the coil magnet.

In one embodiment of the magnetic sensor of the present invention, the flexible coil-magnet comprises a magnetic bar of predetermined length, width, and thickness. The bar magnet has two major surfaces which are defined by the length and width of the bar and has side surfaces. The poles of the bar magnet are the major surfaces, and a uniform magnetic flux density exists across the thickness of the bar between the major surfaces. A coil comprising predetermined number of windings is wound around the side surfaces of the bar, and electrostatic shielding material is utilized to encompass the bar magnet and coil.

A preferred embodiment of the magnet sensor of the present invention comprises aluminum foil as the electrostatic shielding material, a coaxial cable as the two-wire cable, and heat shrinkable tubing as the flexible, non-conductive material.

A method of constructing a magnetic sensor for a musical instrument having vibrating magnetic elements to produce musical notes is also presented. The method comprises constructing a flexible, electrostatically shielded coil magnet, connecting a two-wire cable to the conductors of the coil of the coil magnet, and applying a flexible, non-conductive material to the electrostatically shielded coil-magnet.

In a preferred embodiment, the method of constructing the flexible, electrostatically shielded coil-magnet first comprise selecting a flexible bar magnet of predetermined length, width, and thickness. The poles of the selected bar magnet are the two major surfaces of the bar defined by the length and the width of the bar. The selected magnet should have a uniform magnetic flux density existing between the poles of the magnet across the thickness of the bar.

The preferred method of constructing the coil-magnet then comprises adhesively bonding sheets of electrostatic shielding material to the poles of the magnet. The coil of the coil-magnet is then constructed by winding a predetermined number of turns of a conductor around the side surfaces of bar. The ends of the coil should extend beyond the bar magnet. The preferred method of constructing the coil-magnet lastly comprises folding the sheets of electrostatic shielding material around the bar magnet and coil to electrostatically shield the bar magnet and coil.

A method of adapting an upright piano for electronic amplification is also presented. This method comprises inserting a flexible magnet sensor behind each of the string sections of the upright piano. The flexible magnetic sensors are then attached to the frame of the piano behind the respective string section.

Once adapted for electronic amplification, the sound output of the upright piano may be electronically amplified by coupling the cable of each sensor to the input of a mixing device. The mixing device forms a composite signal from the input signals and presents this composite signal at its output. The composite signal may then be amplified.

BRIEF DESCRIPTION OF THE DRAWINGS

In the accompanying drawings:

FIG. 1*a* is an isometric view which illustrates some of the components comprising an embodiment of the magnetic sensor of the present invention;

FIG. 1*b* is a cross-sectional view taken along line 1*b*—1*b* of FIG. 1*a;*

FIG. 1*c* is an isometric view of the embodiment of the invention which illustrates some of its other components;

FIG. 2 is an isometric view of the embodiment of FIG. 1*c* which has been encompassed by a flexible non-conductive material;

FIG. 3 is an isometric view of a spacer element which may be used in conjunction with the magnetic sensor of the present invention;

FIG. 4*a* is a front view of a portion of the string sections of a piano which illustrates the manner in which an embodiment of the magnetic sensor of the present invention may be installed between the strings and frame of the piano;

FIG. 4*b* is a side view of the portion of the piano shown in FIG. 4*a* taken along line 4*b*—4*b* of FIG. 4*a;*

FIG. 5*a* is an isometric view of a reed block of an accordion which illustrates the manner in which magnetic sensors may be attached to the reed block of the accordion;

FIG. 5*b* is a side view of the reed block shown in FIG. 5*a;*

DESCRIPTION OF THE PREFERRED EMBODIMENT

Figures 6A, 6B:
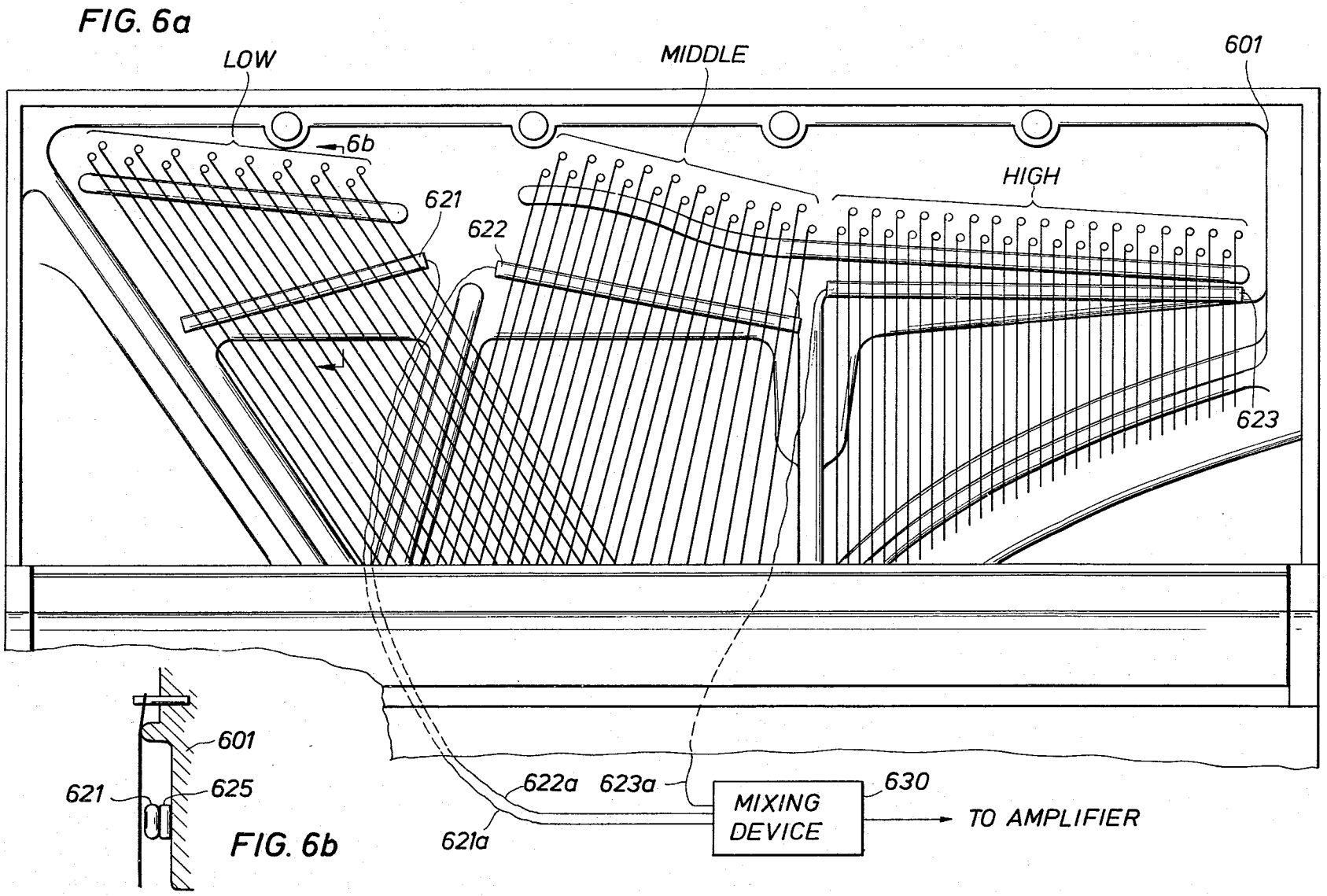
FIG. 6*a* is a front view of an upright piano which illustrates the method by which embodiments of the magnetic sensor of the present invention may be installed in the upright piano.
FIG. 6*b* is a side view of the upright piano of FIG. 6*a* taken along line 6*b*—6*b* of FIG. 6*a*.

It will be appreciated that the present invention can take many forms and embodiments. One embodiment of the invention will be described so as to give an understanding of the invention. It is not intended, however, that the embodiment herein described should in any way limit the true scope and spirit of the invention.

An embodiment of the magnetic sensor of the present invention is designed for use with a musical instrument which comprises a plurality of vibrating magnetic elements to produce the desired musical notes. The magnetic sensor outputs voltages in response to vibration of the vibrating elements, and these voltages are of sufficient level to be compatible with the required input voltages to most commercially available amplifiers. In other words, the output signals of the magnetic sensor require no preamplification. The discussion of an embodiment of the magnetic sensor of the present invention will be presented with reference to its utilization in a piano and in an accordion. It is not intended, however, that this presentation should in any way limit the true scope of the invention.

Referring now to FIG. 1*a*, an embodiment of the magnetic sensor of the present invention comprises coil-magnet 99, which is both flexible and electrostatically shielded. Coil-magnet 99 first comprises magnetic bar 100, which is preferably a vinyl strip-type magnet having a predetermined length (L), width (W), and thickness (T). Bar magnet 100 is illustrated as a rectangular bar, but it will be appreciated that bar magnet 100 need not be precisely rectangular in shape. The length (L) of magnetic bar 100 is chosen to be greater than or equal to the sum of the distances between the individual vibrating elements of the musical instrument whose vibrations are to be detected. For example, an embodiment of the magnetic sensor of the present invention may be utilized in a piano to detect the vibrations of the low note string section. In this instance, the length (L) of bar magnet 100 would be chosen to be greater than or equal to the width of the low note string section of the piano. The width (W) of bar magnet 100 may be chosen to be any convenient dimension, and, in the preferred embodiment of the invention is one-half inch. The thickness (T) is chosen to be as thin as possible, but due to practical limitations is preferably one-eighth of an inch. The major surfaces 100*a* and 100*b* of bar magnet 100, which are the surface areas defined by the length and width of the bar are the poles of the magnet. A uniform magnetic flux density exists across the thickness (T) of bar magnet 100 between the poles, 100*a* and 100*b*, of bar magnet 100.

Still referring to FIG. 1*a*, coil-magnet 99 further comprises sheets 101 and 102 of electrostatic shielding material which are adhesively bound to poles 100*a* and 100*b* of bar magnet 100. This adhesive bonding may be accomplished in any manner which leaves the bar magnet 100 flexible after the adhesion process is complete. For ease of application of the sheets 101 and 102 of electrostatic shielding material, the preferred embodiment of bar magnet 100 has adhesive already applied to poles 100*a* and 100*b*. This magnetic material is vended with an outer non-adhesive coating which may be conveniently removed to accomplish the adhesion of sheets 101 and 102 of electrostatic shielding material to poles 100*a* and 100*b* of bar magnet 100. Such a magnetic material may be obtained from Magnet Sales Company of Los Angeles, California. Also, in the preferred embodiment of the present invention the electrostatic shielding material which is used is aluminum foil.

Still referring to FIG. 1*a*, coil-magnet 99 further comprises coil 105, which comprises a predetermined number of turns of conductor 103. After sheets 101 and 102 of the electrostatic shielding material have been adhesively applied to bar magnet 100, the predermined number of turns of conductor 103 are wound around the side surfaces of bar magnet 100 as shown. In an embodiment of the magnetic sensor of the present invention which is suitble for use with a piano, conductor 103 is 36 gauge wire and 300 turns of it are wound around bar magnet 100. Conductor 103 preferably has a high grade of insulation applied to its exterior so that the turns of coil 105 will not short together after many flexings of magnetic sensor 99. The two ends 103*a* and 103*b* of coil 105 extend beyond coil-magnetic 99 as shown. In FIG. 1*b*, there is illustrated the relationship between bar magnet 100, sheets 101 and 102 of the electrostatic shielding material and conductor 103.

Referring now to FIG. 1*c*, bar magnet 100 with the turns of conductor 103 is electrostatically shielded by folding sheets 101 and 102 of the electrostatic shielding material in the manner as shown. When the electrostatic shielding has been accomplished, ends 103*a* and 103*b* of coil 105 emerge from the electrostatically shielded coil-magnet 99.

Still referring to FIG. 1*c*, an embodiment of the magnetic sensor of the present invention further comprises connector 104. Connector 104 is firmly attached to coil-magnet 99, and, in the preferred embodiment of the invention, the attachment is made by riveting connector 104 to coil-magnet 99. The reason for riveting connector 104 to coil-magnet 99 is to allow the magnetic sensor 99 to be extracted from a musical instrument by pulling on two-wire cable 106 without disturbing the connection of conductor 106 to the conductors of coil 105.

Still referring to FIG. 1*c*, an embodiment of the magnetic sensor of the present invention further comprises a suitable two-wire cable 106. The first connector 106*a* at the first end of two-wire cable 106 is connected together with one end 103*a* of coil 105 to connector 104. This connection may be accomplished by conventional techniques, e.g., soldering. The second conductor 106*b* at the first end of two-wire cable 106 is connected to end 103*b* of coil 105. This connection may also be accomplished by conventional techniques, e.g., soldering. In the preferred embodiment of the magnetic sensor of the present invention, two-wire cable 106 is a coaxial cable and conductor 106*a* is the shield thereof.

Now referring to FIG. 2, the magnetic sensor of the present invention further comprises flexible non-conductive tubing 201. After the attachment of the conductors of two-wire cable 106 as described above is accomplished, non-conductive material 201 is conformed to the exterior shape of the magnetic sensor illustrated in FIG. 1c. In the preferred embodiment of the present invention, non-conductive material 201 is heat shrinkable tubing which shrinks with the applicable of heat to conform to the shape of magnetic sensor 99.

With reference now to FIGS. 4a and 4b, a portion of the string sections of a piano 400 is illustrated. An embodiment of the magnetic sensor 99 is inserted between the strings 401 and the frame 402 of piano 400. If the frame 402 of piano 400 is magnetic, one pole, e.g., 100a of magnetic sensor 99 may be magnetically attached to magnetic frame 402. If the frame 402 of piano 400 is not magnetic, the attachment of magnetic sensor 99 to frame 402 may be made by suitable means, e.g., taping the ends of magnetic sensor 99 to frame 402. When the attachment of magnetic sensor 99 to the frame is made, the other pole 100b is in proximity to the strings 401 of the piano as shown in FIG. 4b. When none of the strings 401 is vibrating, a constant magnetic flux exists between the poles of magnetic sensor 99. When one or more of the strings 401 is caused to vibrate (i.e., a note of piano 400 is struck), the magnetic flux density between poles 100a and 100b of magnetic sensor 99 is changed. Consequently, a voltage is induced across coil 105 of magnetic sensor 99. This induced voltage tends to restore the magnetic flux density to its previous constant value. Since the ends 106a and 106b of two-wire conductor 106 are connected to the ends 103a and 103b, respectively, of coil 105, this induced voltage is present across conductors 106a and 106b at the second end of two-wire cable 106. A suitable connector 107 may be coupled to the second end of two-wire cable 106 for insertion into a suitable amplifying or mixing device.

Still referring to FIGS. 4a and 4b, if frame 402 is magnetic, then either pole 100a or 100b will magnetically attach to the frame 402 of piano 400. When this magnetic attachment is accomplished, the pole of the magnetic sensor not attached to frame 402 should preferably lie in a plane parallel to the plane of the strings. Furthermore, it is desirable that there be a minimum of space between the strings 401 and the unattached face of magnetic sensor 99. If the distance between the strings 401 of the piano and the unattached face of the magnetic sensor is too great, then a spacer element may be required.

With reference now to FIG. 3, an embodiment of the magnetic sensor of the present invention may also comprise spacer element 300. Spacer element 300 preferably comprises a bar magnet 301 which is similar to bar magnet 100. Spacer element 300 also comprises non-conductive material 302 which is formed around bar magnet 301. In the preferred embodiment of the magnetic sensor of the present invention, non-conductive material 302 is heat shrinkable tubing which, upon the application of heat, shrinks to conform to the shape of bar magnet 301. The utilization of spacer element 300 will be illustrated below with reference to FIGS. 6a and 6b.

With reference now to FIGS. 5a and 5b, there is illustrated the manner in which an embodiment of the magnetic sensor 99 may be installed on an accordion 500. The reed block 510 of a typical accordion 500 comprises four rows 506–509 of holes 501 in surface 502. Surface 502 is smoothly tapered from end 503 to end 504 of accordion 500. A reed 505 is inserted in each hole 501, and, as the accordion 500 is operated, air is forced by the reed 505 corresponding to the desired note. This forced air causes the reed to vibrate and produce the musical note.

With reference still to FIGS. 5a and 5b, magnetic sensors 521–524 may be installed on accordion 500 by first securing support blocks 515 and 516 to surface 502 at ends 503 and 504 as shown. One magnetic sensor is then suspended above each row 506–509 of reeds 505. The ends of each magnetic sensor 99 are connected to support blocks 515 and 516 by suitable means, e.g., gluing. Since an embodiment of the magnetic sensor of the present invention is flexible, each magnetic sensor 521–524 may be conformed to the taper of surface 502 of accordion 500. Since four magnetic sensors are utilized, it is necessary to mix the outputs of the sensors prior to amplification. A suitable mixing device is the Helpinstill Model 175, such as manufactured by Helpinstill Designs of Houston, Texas.

Referring now to FIG. 6a, there is illustrated a method by which an upright piano 600 may be adapted for electrical amplification by utilizing three magnetic sensors 621–623, each of which are constructed in accordance with the foregoing discussion.

When viewed from the front, an upright piano 600 comprises a plurality of string sections, which are designated in FIG. 6a as the low note, middle note and high note sections, and a frame 601. A magnetic sensor is inserted between each string section and the frame 601 as shown. Since each magnetic sensor 621–623 is flexible, each may be flexed in order to install it behind the respecive string section.

Each magnetic sensor 621–623 may be positioned to a desired location behind the respective string sections. Once in position, each magnetic sensor is attached to frame 601 in a convenient manner. If frame 601 is magnetic, one major surface of each magnetic sensor may be magnetically attached to frame 601. If, however, frame 601 is not magnetic, then each magnetic sensor 621–623 may be attached to framd 601 by suitable means, e.g., such as taping the ends of each magnetic sensor to the frame.

It has been observed that with most upright pianos there is a greater distance between the low note string section and the frame 601 of the piano than there is between either the middle note or high note section and frame 601. This being the case, it has often been necessary to utilize a spacer element with the magnetic sensor used in conjunction with the low note string section. FIG. 6b illustrates the manner in which spacer 625 (spacer 300 of FIG. 3) is inserted between frame 601 and magnetic sensor 621. The utilization of spacer 625 enables one major surface of magnetic sensor 621 to be in proximity to the strings of low note section.

Referring again to FIG. 6a, when upright piano 600 has been adapted for electrical amplification in the manner described above, the sound output of piano 600 may be electronically amplified by coupling the cables 621a–623a to the inputs of a suitable mixing device 630. Mixing device 630 mixes the outputs of sensors 621–623 to form one composite signal which appears at its output. This output may then be coupled to a suitable amplifying device (not shown), which would amplify the composited signal. A suitable mixing device 630 is the Helpinstill Model 75 which is vended by Helpinstill Designs of Houston, Texas. When this mixing device is utilized, the composited signal is available at both a low impedance output and a high impedance output. This enables the composited signal to be either coupled to an amplifier having a low impedance, e.g., a typical public address system amplifier, or an amplifier having a high input impedance, e.g., a typical guitar amplifier.

The foregoing description of the magnetic sensor of the present invention has been directed to a particular preferred embodiment in accordance with the requirements of the Patents Statutes and for the purpose of explanation and illustration. It will be apparent, however, to those skilled in the art that many modifications in both apparatus and method may be made without departing from the scope and spirit of the invention. It is the Applicant's intention in the following claims to cover all such equivalent modifications and variations as fall within the true scope and spirit of the invention.

What is claimed is:

1. A magnetic sensor for a musical instrument having vibrating magnetic elements to produce musical notes, which magnetic sensor is suitable for attachment to the frame of the instrument and which magnetic sensor produces an electronic signal in response to the vibration of any of the vibrating magnetic elements, comprising;

a flexible, electrostatically shielded, coil-magnet comprising:

a flexible bar magnet of predetermined length, width and thickness, the bar magnet having two major surfaces defined by the length and width of the bar magnet and having side surfaces, wherein the poles of the magnet are the major surfaces and wherein a uniform magnetic flux density exists across the thickness of the bar between the poles of the bar magnet;

a coil comprising a predetermined number of windings of a conductor which are wound around the side surfaces of the bar magnet; and electrostatic shielding material which is adhesively bound to the major surfaces of said bar magnet and which encompasses and encloses said bar magnet and windings;

a two-wire cable connected to the ends of the coil of said coil-magnet; and flexible, non-conductive material encompassing said coil-magnet and the connection of the two-wire cable to the coil of the coil-magnet.

2. The magnetic sensor of claim 1, wherein it additionally comprises a magnetic spacer for insertion between the magnetic sensor and the frame of the musical instrument to bring the magnetic sensor into proximity to the vibrating strings of the instrument.

3. The magnetic sensor of claim 2, wherein the magnetic spacer comprises:

a flexible bar magnet having a predetermined length, width, and thickness; and flexible, non-conductive material applied to the bar magnet.

4. The magnetic sensor of claim 3, wherein the flexible, non-conductive material applied to the bar magnet is heat shrinkable tubing.

5. The magnetic sensor of claim 4, wherein the electrostatic shielding material is aluminum foil.

6. The magnetic sensor of claim 4, wherein the two-wire cable is a coaxial cable.

7. A magnetic sensor for an instrument having vibrating magnetic elements to produce musical notes and a magnetic frame, which magnetic sensor is suitable for attachment to the frame of the instrument and which magnetic sensor produces an electrical signal in response to the vibration of the vibrating magnet material, comprising:

a flexible bar magnet of predetermined length, width, and thickness, the bar magnet having two major surfaces defined by the length and width of the bar magnet and having side surfaces, wherein the poles of the magnet are the major surfaces and wherein a uniform magnetic flux density exists across the thickness of the bar between the poles of the bar magnet;

a coil comprising a predetermined number of windings of a conductor wound around the side surfaces of the bar magnet;

electrostatic shielding material encompassing and enclosing said bar magnet and windings;

a two-wire cable with one conductor thereof attached to one side of the coil of the coil magnet and with the other conductor thereof attached to the other side of the coil of the coil magnet; and flexible, non-conductive material encompassing the electrostatically shielded bar magnet with windings and the connection of the two-wire cable to the conductors of the coil magnet.

8. A method of constructing a magnetic sensor for an instrument having vibrating magnetic elements to produce musical notes, which comprises:

selecting a flexible bar magnet of predetermined length, width and thickness, the bar magnet having two major surfaces defined by the length and width of the bar magnet and having two side surfaces, wherein the poles of the selected bar magnet are the major surfaces and the bar magnet having a uniform magnetic flux density across the thickness of the magnet between the poles of the magnet;

adhesively bonding sheets of electrostatic shielding material to the poles of the bar magnet;

constructing the coil of the coil magnet by winding a predetermined number of turns of a conductor around the side surfaces of the magnet, the turns of said coil encircling the bar magnet;

folding the sheets of electrostatic shielding material around the bar magnet and the coil to electrostatically shield the bar magnet and coil;

connecting the conductors of a two-wire cable to the ends of the coil of the coil-magnet; and applying a flexible, non-conductive material to the flexible, electrostatically shielded coil-magnet.

9. The method of claim 8, wherein the electrostatic shielding material is aluminum foil.

10. The method of claim 8, wherein the flexible non-conductive material is heat shrinkable tubing and thereafter applying heat to shrink the tubing.

11. The method of claim 8, wherein the two-wire cable is a coaxial cable.

12. A method of constructing a magnetic sensor for an instrument having vibrating elements to produce musical notes, which comprises:

selecting a vinyl bar magnet of predetermined length, width and thickness, the vinyl bar magnet having two major surfaces defined by the length and width of the bar magnet, wherein the poles of the magnet are the major surfaces and wherein a uniform magnetic flux density exists between the poles of the bar magnet;

adhesively bonding sheets of aluminum foil to the poles of the bar magnet;

constructing the coil of the coil-magnet by winding a predetermined number of turns of a conductor around the side surfaces of the magnet, the turns of said coil encircling the bar magnet;

folding the sheets of the aluminum foil around the bar magnet and coil to electrostatically shield the bar magnet and coil;

attaching a connector to the bar magnet;

selecting a coaxial cable of predetermined length;

connecting one end of the coil and the shield at a first end of the coaxial cable to the connector;

connecting the second end of the coil to the center connector of the coaxial cable at the first end of the coaxial cable;

encompassing the electrostatically shielded coil-magnet and the connector with heat shrinkable tubing;

applying heat to the heat shrinkable tubing to cause it to conform to the shape of the coil-magnet; and connecting a connector to the second end of the coaxial cable.

13. The method of claim 12, wherein the coil comprises 300 turns of the conductor.

14. A method of adapting an upright piano for electric amplification, the upright piano having a plurality of string sections, a frame and a space between each string section and the frame utilizing a flexible magnetic sensor which flexible magnetic sensor comprises:

(a) a flexible, electrostatically shielded coil magnet;

(b) a two-wire cable connected to the ends of the coil of the coil magnet; and (c) flexible, nonconductive material encompassing the coil magnet and the connection of the two-wire cable to the coil of the coil magnet;

the method comprising the steps of:

(1) inserting a flexible magnetic sensor into the space between one string section and the frame of the piano, the magnetic sensor being of a length greater than or equal to the width of that string section and the magnetic sensor having two major surfaces which are magnetic;

(2) attaching one major surface of the magnetic sensor to the frame of the upright piano; and (3) repeating steps (1) and (2) for each string section of the piano.

15. A method of adapting an upright piano for electric amplification, the upright piano having a plurality of string sections, a frame and a space between each string section and the frame wherein the method utilizes a flexible magnetic sensor which comprises:

(a) a flexible bar magnet having a length greater than or equal to the width of the string section behind which the magnetic sensor is inserted and having a predetermined width and thickness, the bar magnet having two major surfaces defined by the length and width of the bar magnet and having side surfaces, wherein the poles of the magnet are the major surfaces and wherein a uniform magnetic flux density exists across the thickness of the bar between the poles of the bar magnet;

(b) a coil comprising a predetermined number of windings of a conductor wound around the side surfaces of the bar magnet;

(c) electrostatically shielding material encompassing and enclosing said bar magnet and windings;

(d) a two-wire cable with one conductor thereof attached to one side of the coil of the coil magnet and with the other conductor thereof attached to the other side of the coil of the coil magnet; and (e) flexible, nonconductive material encompassing the electrostatically shielded bar magnet with windings and the connection of the two-wire cable to the conductors of the coil magnet;

the method comprising the steps of:

(1) inserting a flexible magnetic sensor into the space between one string section and the frame of the piano, the magnetic sensor being of a length greater than or equal to the width of that string section and the magnetic sensor having two major surfaces which are magnetic;

(2) attaching one major surface of the magnetic sensor to the frame of the upright piano; and (3) repeating steps (1) and (2) for each string section of the piano.

* * * * *